US006150643A

United States Patent [19]

Kitamura et al.

[11] Patent Number: 6,150,643

[45] Date of Patent: Nov. 21, 2000

[54] INSULATING MATERIAL, ELECTRICAL HEATING UNIT EMPLOYING SAME, AND MANUFACTURING METHOD THEREFOR

[75] Inventors: Koichi Kitamura, Tenri; Masaaki Ueda, Gose; Hiroyuki Hanaya, Tenri, all of Japan

[73] Assignee: Koyo Thermo Systems Co., Ltd., Tenri, Japan

[21] Appl. No.: 09/327,570

[22] Filed: Jun. 8, 1999

[51] Int. Cl.[7] ..... H05B 3/06

[52] U.S. Cl. ..... 219/542; 219/544; 219/546; 373/127; 373/137

[58] Field of Search ..... 219/536, 542, 219/544, 546, 548; 373/128, 130, 137; 428/76, 209; 266/280

[56] References Cited

U.S. PATENT DOCUMENTS

| | | | |
|---|---|---|---|
| 1,997,622 | 4/1935 | Benner et al. | 373/137 |
| 3,540,713 | 11/1970 | Montgomery | 373/128 |
| 3,869,334 | 3/1975 | Hughes et al. | 428/76 |
| 4,493,089 | 1/1985 | Abell | 373/130 |
| 4,575,619 | 3/1986 | Porzky | 219/542 |
| 5,332,200 | 7/1994 | Gorin et al. | 266/280 |
| 5,614,292 | 3/1997 | Saylor | 428/209 |

*Primary Examiner*—Tu Ba Hoang
*Attorney, Agent, or Firm*—Armstrong, Westerman, Hattori, McLeland & Naughton

[57] ABSTRACT

The present invention is a heat insulating material being a single unit having superior insulating performance as well as sufficient mechanical strength itself to constitute furnace walls, an electric heating unit having the heat insulating material and a method of manufacture of the heat insulating material and the electrical heating unit. The heat insulating material of the present invention includes an outer layer having mainly refractory inorganic fibers and a core layer supported within the outer layer. The outer layer has greater mechanical strength than the core layer. The core layer has a composition having a better insulating performance than the outer layer and extends in a plane substantially perpendicular to the thickness of the heat insulating material. The electrical heating unit of the present invention has a heating element embedded in the heat insulating material.

12 Claims, 3 Drawing Sheets

INSULATING MATERIAL, ELECTRICAL HEATING UNIT EMPLOYING SAME, AND MANUFACTURING METHOD THEREFOR

BACKGROUND OF THE INVENTION

1. Field of the Invention

The present invention relates to insulating material and an electrical heating unit employing same, which are used in heating apparatuses such as various types of industrial furnaces and experimental furnaces, and a manufacturing method therefor.

2. Description of the Related Art

Insulating material of vacuum formed ceramic fiber has a high insulating performance, is lightweight, and can also be shaped into arbitrary forms. Moreover, this insulating material has sufficient strength and is easy to handle; secondary machining is also easy. This material has been used effectively for improving the loss of heat energy from furnace walls. Electrical heating units using this insulating material are also known. For example, U.S. Pat. No. 3,500,444 discloses a technique for economically manufacturing an electrical heating unit by embedding a heating element near one surface of such insulating material. Also, U.S. Pat. No. 4575619 discloses a grooved electrical heating unit, comprising a serpentine heating element, with improved thermal radiation characteristics.

These electrical heating units have the advantages that they can be formed into arbitrary shapes and they have the same superior insulating performance as the abovementioned insulating material itself, of which they are formed. Furthermore, they have the advantage of having sufficient mechanical strength that they can alone constitute furnace walls. Consequently, because it is easy to assemble a furnace by using these in an appropriate combination, it becomes possible to greatly reduce labor in constructing a furnace and thus contributing greatly to the cost reductions of energy conserving furnaces.

Since then, however, the industrial sector has become more and more strict about reducing environmental loads because of the increased attention to global environmental problems. These problems have become manifest and their resolution is an issue for all people. Making furnaces much more energy efficient is therefore a significant task.

Meanwhile, the insatiable pursuit of improved insulating performance has drawn attention to the properties of microporous material such as silica aerogel, especially with its micro-spherical structure with a minute closed vacancy, smaller than the mean free path of gas. Thus, so-called microporous insulating material has been developed which has an ultimate insulating performance, i.e. ability to theoretically eliminate the convective heat transfer between voids in the insulating material.

Related technologies include U.S. Pat. No. 3,869,334 which shows how a high performance insulating material, which can be handled as an ordinary insulating material, is attained by enclosing silica aerogels in a bag made of fiberglass cloth and pressure forming same into a flat panel. The insulating performance is known to be much better than that of a vacuum formed ceramic fiber. As a result of achievements in manufacturing technologies, recently silica aerogel materials formed directly into boards are also available because the strength thereof has been improved by blending the aerogel with refractory fiber material or the like, instead of enclosing it in the abovementioned bag.

These available microporous insulating materials comprising silica aerogels or the like are essentially low in strength because of the characteristic structure of silica aerogel as a constitutional element; specifically, a micro-spherical shell containing a hollow in it. In addition, available thickness is also limited, so it is not possible to construct the furnace walls with these alone. Hence the use of these materials as insulating material for furnaces is limited to backup material or intermediate layers of lining material. While use in such forms can ensure energy conservation, this usage has the problems of increasing the labor in constructing the furnaces and adding up costs. Also, especially when in board form, these materials are easily damaged or broken during construction and much expensive material is wasted.

SUMMARY OF THE INVENTION

It is an object of the present invention to resolve the abovementioned problems with the conventional art. It is therefore an object of the present invention to provide a high performance insulating material which can greatly reduce heat loss from furnace walls in comparison to conventional ceramic fiber formed insulating material, which can be manufactured in a simple and inexpensive way, and which has sufficient mechanical strength to solely constitute furnace walls, with easy assembly, requiring less labor for constructing a furnace; to provide an electrical heating unit using same; and to provide a manufacturing method therefor.

The insulating material relating to the present invention is an insulating material including an outer layer comprising mainly refractory inorganic fiber and a core layer contained within and joined to the outer layer. The outer layer has a greater mechanical strength than the core layer; the core layer comprises a composition having a higher insulating performance than the outer layer. The core layer extends in a plane substantially perpendicular to the thickness of the insulating material.

With the constitution of the present invention, a high strength composition comprising mainly refractory inorganic fibers becomes the outer layer. The insulating material is provided with sufficient strength by this layer with the core layer having a higher insulating performance and being completely enclosed inside and protected thereby. Because the core layer extends in a plane substantially perpendicular to the heat flow and is joined with and supported within the outer layer, the insulating performance of the insulating material is superior to that of an insulating material comprising only the composition forming the outer layer. This insulating material can therefore alone constitute furnace walls with especially good insulating performance because of the combination of superior insulating properties with a mechanical strength sufficient to form furnace walls.

In the insulating material of the present invention, the abovementioned core layer preferably comprises an essentially microporous insulating material. An insulating material with a high strength and an insulating performance much greater than conventional ones are thereby attained; this material can alone constitute furnace walls with an insulating performance markedly higher than conventional walls.

Here, microporous insulating material means an insulating material including an essential percentage of a microporous material such as silica aerogel such that the properties derived from the micropores are reflected in the whole. For example, the insulating material can comprise 50 percent weight or more of the microporous material, with the remainder consisting of material such as reinforcing elements, opacifiers, and binders etc. Moreover, the numerical value of 50 percent weight given here is merely an illustration and the present invention is not limited by this. The present invention can also includes microporous material packed in said fiberglass bag or formed microporous material provided in the shape of boards.

The electrical heating unit relating to the present invention comprises insulating material supporting a heating element, at least part of which is embedded near one surface of the outer layer, with terminals for supplying electric power to the heating element protruding from the surface opposite therefrom. This insulating material comprises an outer layer composed mainly of refractory inorganic fiber and a core layer joined to and held within the outer layer. The outer layer has greater mechanical strength than the core layer, while the core layer comprises a composition with better insulating performance than the outer layer; the core layer extends in a plane substantially perpendicular to the thickness of the insulating material.

In this way, the high strength composition composed mainly of refractory inorganic fiber becomes the outer layer, which completely encloses and protects the core layer having a insulating performance better than this outer layer. The insulating material is thereby provided with sufficient strength. Also, the core layer extends in a plane substantially perpendicular to the heat flow and is supported within the outer layer; the insulating performance of the entire insulating material is therefore superior to that of the composition forming the outer layer.

Also, the heating element and the terminals for supplying electrical power to this heating element are embedded at least partially in the insulating material near a surface of the outer layer and the opposite surface respectively, thereby supported in position with sufficient strength. Consequently, the heating unit can alone constitute highly insulated furnace walls with built-in heating elements.

In the electrical heating unit relating to the present invention, it is preferable that the core layer essentially comprise microporous insulating material. An electrical heating unit with markedly better insulating performance is thereby attained.

In the electrical heating unit relating to the present invention, it is sometimes the case that one or more grooves are formed in one surface of the outer layer and at least part of the heating element is embedded near the bottom of that groove and is supported thereby. In that case, an electrical heating unit with superior heat radiation properties, as well as insulating properties, is attained.

The method for manufacturing the insulating material relating to the present invention forms the insulating material as follows: build up under compressive force a first insulating layer comprising mainly refractory inorganic fiber to a prescribed thickness; spread and position on that deposited surface a core layer which comprises a composition having insulating performance superior to the first insulating layer and which has surface dimensions smaller than the deposited surface area of the first layer; then build up under compressive force a second insulating layer comprising mainly refractory inorganic fiber to completely enclose the core layer at a prescribed position therein.

It thereby becomes possible to manufacture an insulating material wherein the core layer with the high insulating performance is enclosed within a high strength outer layer, and that core layer spreads in a plane substantially perpendicular to the thickness of the insulating material and is supported and joined to the outer layer at a prescribed position. This insulating material has a mechanical strength sufficient to constitute furnace walls on its own and has superior insulating properties.

In the method for manufacturing an insulating material relating to the present invention, it is preferable that the first and second insulating layers be built up using vacuum forming. The material can thereby be easily manufactured in any desired shape at low cost with high quality.

In the method for manufacturing an insulating material relating to the present invention, it is preferable that the principal binder be inorganic colloidal silica. An insulating material with sufficient heat resistance and strength from normal to high temperatures, and an electrical heating unit can thereby be easily manufactured.

In the method for manufacturing an insulating material relating to the present invention, it is preferable that an aqueous slurry be used. Then, preparation is easy and the manufacturing process does not require special waste solution processing, thereby allowing low cost production.

In the method for manufacturing an insulating material relating to the present invention, it is preferable that the core layer, essentially comprising microporous insulating material, be formed with a waterproof membrane therearound, in the case where the first and second insulating layers are formed from an aqueous slurry wherein are dispersed refractory inorganic fiber. The microporous insulating material can thereby be prevented from contacting water in the forming process; this prevents damage to the aerogel structure constituting the microporous insulating material and the superior insulating performance can be maintained.

The waterproof membrane covering the core layer may be a type which disappears when heated, or oppositely, may be heat resistant.

In the case of the former, the membrane can easily be removed by heating when the waterproof membrane becomes unnecessary, such as after the final drying stage following forming. In the case of the latter, the membrane can remain without alteration thereto within the product and can withstand use at high temperatures.

The first and second insulating layers may be of the same material, or may be different in accordance with known technology depending on a choice made based on the heat resistance requirements on each layer.

The method for manufacturing the electrical heating unit is a method wherein the abovementioned method for manufacturing the insulating material is modified such that it includes locating the heating element at a prescribed position, building up the first insulating layer, and embedding at least part of the heating element at a prescribed position near the surface of the first insulating layer.

With this constitution, it is possible to manufacture an electrical heating unit with a built-in heating element and having a strength sufficient to form furnace walls on its own and superior insulating performance.

Moreover, any known heating elements may be used and how they are embedded does not matter.

DESCRIPTION OF THE PREFERRED EMBODIMENTS

The preferred embodiments of the present invention are explained below with reference to the figures. The drawings shown here are approximations; the relative sizes of the portions are not accurate and should not be referenced in actual practice.

First Embodiment

Figure 1:
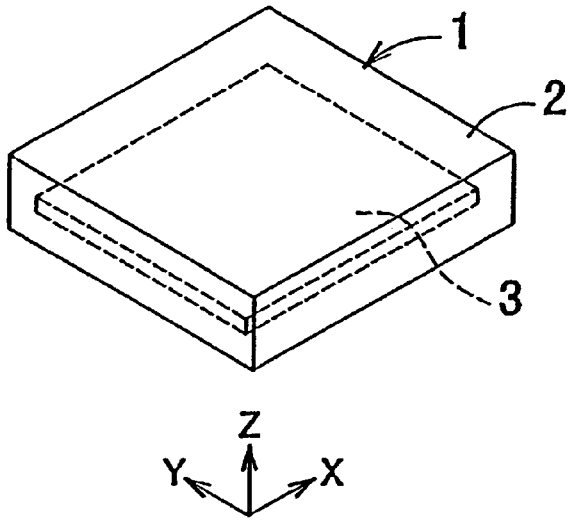
FIG. 1 shows a summary of the insulating material relating to the present invention.

FIG. 1 shows an embodiment of the insulating material 1 of the present invention.

The insulating material 1 comprises an outer layer 2 and a core layer 3; the core layer 3 is embedded within the outer layer.

The surface of the core layer 3 extends in the xy plane, which is a plane substantially perpendicular to the thickness of the insulating material 1 (z direction in the drawing), i.e. the direction of heat flow when the insulating material is used.

The outer layer 2 is a deposited layer, comprising mainly ceramic fiber, which is attained through vacuum forming using an inorganic binder. Meanwhile, the core layer 3 is a commercially available board of microporous insulating material.

In this case, the core layer 3 has an insulating performance much better than the outer layer 2. The outer layer 2 has sufficient mechanical strength and protects the core layer 3 and ensures the strength of the insulating material 1 as a whole. Consequently, the insulating material can be used alone to constitute furnace walls.

The microporous insulating material can be acquired in the form of an insulating board, 10–50 mm thick with a bulk specific gravity of 0.2–0.5, comprising mainly silica aerogel. This makes the core layer 3. The outer layer 2 can be built up using a known vacuum forming method from a slurry prepared by dispersing commercially available aluminosilicate bulk ceramic fiber in water and adding a colloidal silica binder thereto. The bulk specific gravity of the outer layer 2 is about 0.2. An insulating material can thereby be made by completely surrounding and joining the core layer 3 with the outer layer 2. Before vacuum forming, the core layer is placed and sealed in a plastic bag in advance to prevent it from contact with water. This becomes the waterproof membrane 4. If silica aerogel came in contact with water, the micropore structure would be destroyed because of surface tension generated during drying; as a result, the desired insulating effects could not be attained.

The procedures of the method for manufacturing the insulating material are explained with reference to FIGS. 2 and 3. In the following explanation, the material undergoing vacuum forming is called the insulating layer; the material which as been completely formed and then dried and hardened is called the insulating material.

Figure 2:
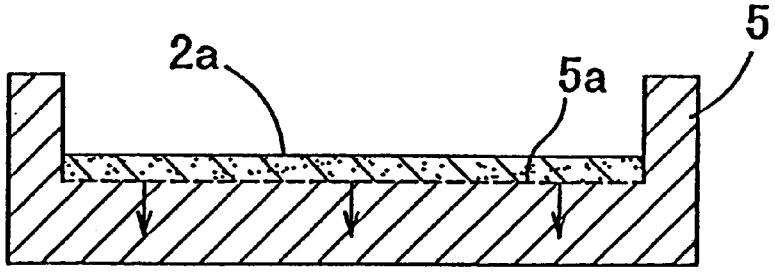
FIG. 2 shows a summary of the method for manufacturing the insulating material relating to the present invention; this is the point where the first insulating layer is built up.
Figure 3:
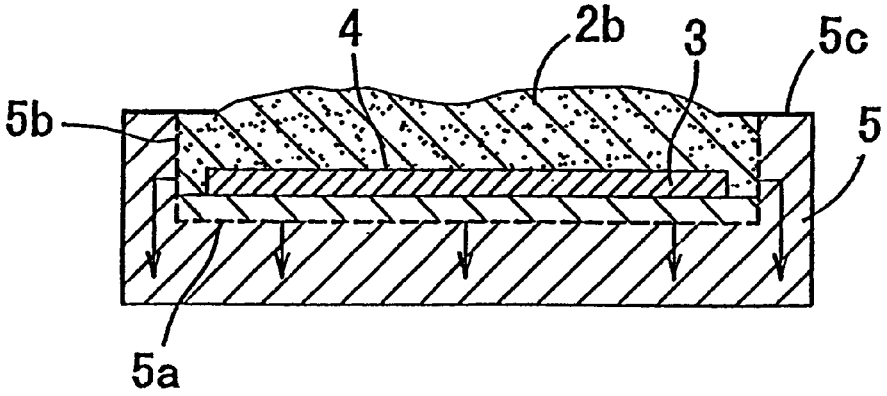
FIG. 3 shows a summary of the method for manufacturing the insulating material relating to the present invention; this is the point where the second insulating layer is built up.

As shown in FIG. 2, a first insulating layer 2*a*,of the prescribed thickness, is built up within the mold 5 using vacuum forming method. At this time suction, specifically vacuum suction force, is applied only to a bottom screen 5*a*. This becomes part of the outer layer 2. This layer is built up usually to a thickness of 15–80 mm. Next, the surface of the core layer 2, the dimensions of which are somewhat smaller than the deposited surface of the first insulating layer 2*a*, is covered with a waterproof membrane 4. This core layer 2 is positioned at a prescribed location on the deposited surface and a second insulating layer 2*b* of a prescribed thickness is formed as shown in FIG. 3, again with vacuum forming. At this time, a side screen 5*b* is used in addition to the bottom screen 5*a*; suction is applied through both these screens. The built up thickness here is usually 80–15 mm. This becomes another part of the outer layer 2 and the entirety, i.e. the first insulating layer 2*a*,core layer 3, and the second insulating layer 2*b*, is compressed together to form the insulating material 1. The vacuum forming process itself and subsequent processes are known to person having ordinary skill in the art, but these are discussed in general below.

Vacuum forming is based on the principle where suction generates a flow of slurry toward the screens 5*a*, 5*b* in the mold and the screens 5*a*, 5*b* strain out the fiber component, which builds up and is compressed on the surface of the mold 5. The filtrate is recirculated and reused. The approximate shape of the insulating material 1 is formed during the flow of slurry through screens 5*a, b*. Of course the exterior shape is determined by the shape of the mold used.

Also, a removable top plate 5*c* is attached on the mold 5. The top plate 5*c* has an opening in the center and regulates the shape of the side of the upper surface of the insulating layer built up during vacuum forming.

After removal from the mold 5, the deposited insulating layer is dried in an oven. After drying, the outer layer gains sufficient strength due to the effects of the binder.

Next, the outer shape is machined to its final form. The new surface created in the final machining is further dipped in a binder solution and then dried again and hardened.

An insulating material 1, having superior insulating performance and a strength sufficient to constitute furnace walls on its own, can be manufactured easily and inexpensively by the abovementioned processes.

Because the object is to prevent the core layer 3 from contact with moisture during the abovementioned forming process, the plastic bag used as the waterproof membrane 4 may be removed after most of the moisture is removed from the insulating material in the final drying process. It is economical to remove the waterproof membrane 4 successively by increasing the temperature after drying is complete.

Comparative testing was performed to verify the effects of the present invention.

The insulating material according to the present invention, prepared with a core layer of a silica aerogel board with thickness 25 mm and bulk specific gravity 0.3, and a separate vacuum formed insulating material comprising conventional ceramic fiber were used to constitute a separate furnace wall, respectively. The furnace was operated at internal temperature of 1000° C. And surface temperatures were measured after the furnaces reaching a steady state, and heat loss was calculated from the results of the measurement. The tests were performed for furnace wall thicknesses of 100 mm and 125 mm, respectively. Tables 1 and 2 show the results.

TABLE 1

| Type | Furnace wall thickness of 100 mm: Insulating layer thickness (mm): First outer layer | Core layer | Second outerlayer | Heat loss (%) |
|---|---|---|---|---|
| Conventional | 100 | — | — | 100 |
| Invention | 20 | 25 | 55 | 71.5 |

TABLE 2

| Type | Furnace wall thickness of 125 mm: Insulating layer thickness (mm): First outer layer | Core layer | Second outerlayer | Heat loss (%) |
|---|---|---|---|---|
| Conventional | 125 | — | — | 100 |
| Invention | 80 | 25 | 20 | 75.5 |

As clear from these results, this case showed improvements in insulating performance of 25–30% better than the conventional case, regardless of the thickness of the insulating layer and the position of the embedded core layer, meaning the proportions of the first and second layers in the constitution. Consequently, varying the ratio of core layer to outer layer makes it possible to attain an even better insulating performance with the present invention.

Second Embodiment

Figure 4:
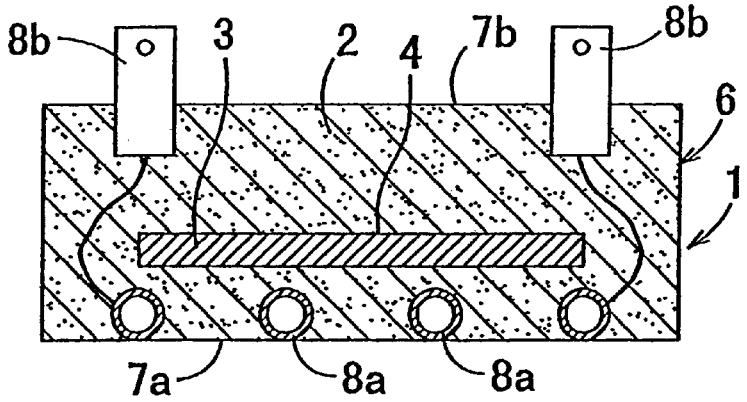
FIG. 4 is a cross sectional view for explaining the electrical heating unit relating to the present invention.

FIG. 4 shows the electrical heating unit 6 relating to the present invention.

Heating coils 8*a* are embedded near the surface 7*a* perpendicular to the thickness of the insulating material 1. These heating coils 8*a* are secured in the insulating material 1 and constitute an electrical heating unit 6. Also, terminals 8*b* for supplying power to the heating coils 8*a* protrude from the opposite surface 7*b* in the direction of the thickness of the insulating material 1.

The insulating material 1 of the electrical heating unit 6 has the same constitution as the first embodiment and comprises an outer layer 2 and core layer 3. Here the heating coils 8*a* and terminals 8b are both positioned and secured in the outer layer 2 of the insulating layer of the electrical heating unit 6. With such constitution, the electrical heating unit 6 relating to the present invention can have a mechanical strength sufficient to construct furnace walls on its own and the same insulating performance as explained in the first embodiment. Consequently, using this electrical heating unit 6 makes it possible alone to construct furnace walls with superior insulating performance and built-in heating elements.

This electrical heating unit 6 is also manufactured using vacuum forming process. This is summarized as follows with reference to FIGS. 5 and 6.

Figure 5:
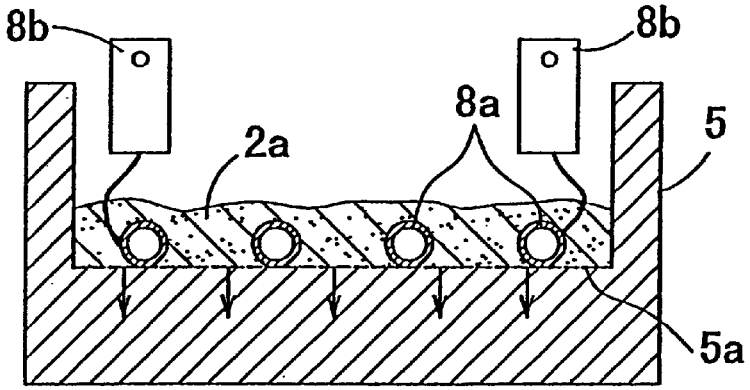
FIG. 5 shows a summary of the method for manufacturing the electrical heating unit relating to the present invention; this is the point where the first insulating layer is built up.

As shown in FIG. 5, the heating coils 8*a* and terminals 8*b* are located at the desired position in the mold 5 and a first insulating layer 2*a* is built up to the prescribed thickness. At this time, the thickness of the first insulating layer 2*a* is greater than the thickness of the heating coils 8*a*. This forms the basic structure wherein the first insulating layer 2*a* supports the heating coils 8*a*.

Figure 6:
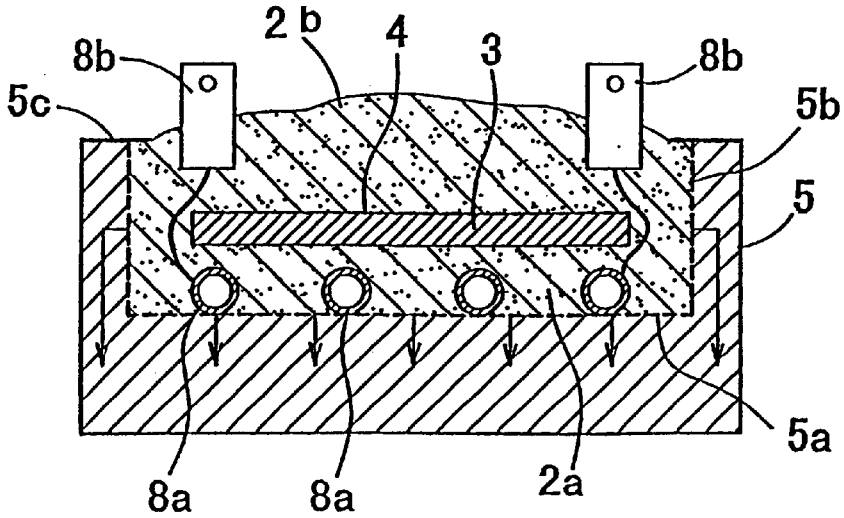
FIG. 6 shows a summary of the method for manufacturing the electrical heating unit relating to the present invention; this is the point where the second insulating layer is built up.

Afterwards the method in the first embodiment may be followed, but the terminals 8*b* are partially embedded within the second insulating layer 2*b*, as shown in FIG. 6, when building up the second insulating layer 2*b* at the end of those processes. This forms the basic structure wherein the second insulating layer 2*b* supports the terminals 8*b*. Afterwards exactly the same processes used in the first embodiment are carried out. The electrical heating unit 6 can be efficiently and inexpensively manufactured by this method.

The shape of the heating element embedded at least partially in the first insulating layer 2*a* may be a compressed coil, serpentine shape, or other shape, as well as the above-mentioned round coil shape.

Third Embodiment

Figure 7:
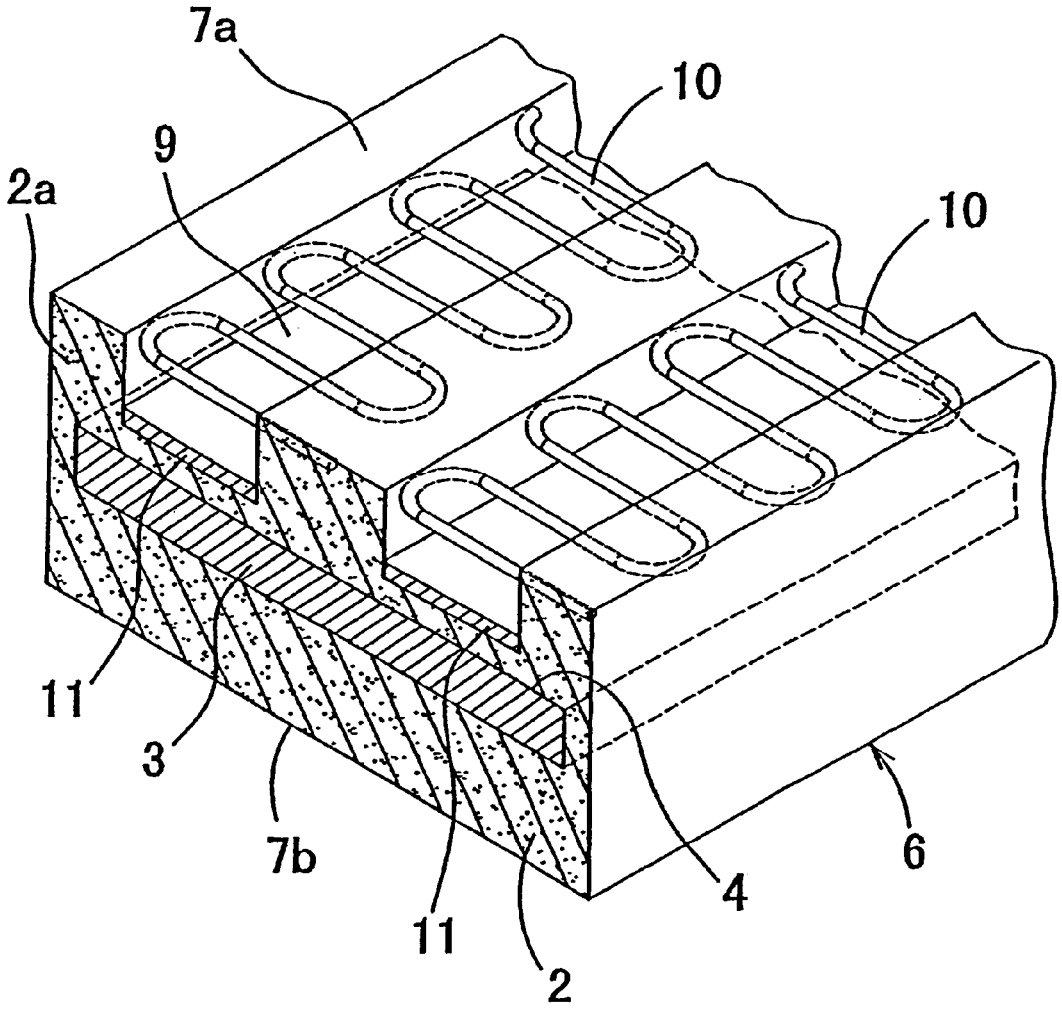
FIG. 7 is a cross sectional view of another embodiment of the electrical heating unit relating to the present invention.

This embodiment preferably has the form shown in FIG. 7. In this embodiment, a groove 9 is formed in the first insulating layer 2*a*, a serpentine heating element 10 is placed near the bottom of that groove 9, and a bottom-forming member 11 is embedded in the bottom of the groove 9 below the heating element. This constitution is shown in detail in U.S. Pat. No. 5,847,368. Installing the bottom-forming member 11 helps to prevent the serpentine heating element 10 from being buried in the insulating layer 2*a*. The exposure of the serpentine heating element 10 can be made as great as possible. It is also possible to modify the bottom-forming member 11 to include microporous insulating material. If that is the case, the insulating performance to the rear of the heating element is further improved and an electrical heating unit with still better radiation characteristics and insulating characteristics can be manufactured.

Furthermore, the examples explained above were of a panel-shaped insulating material and electrical heating unit, but products in other shapes, such as ones having part of cylindrical or spherical surface, can be manufactured with the same method as above.

The embodiments explained above used aluminosilicate ceramic fiber as the refractory inorganic fiber forming the principal component of the outer layer 2, but other types of ceramic fiber may also be used. Also, the bulk specific gravity of the outer layer 2 after vacuum forming is not restricted as that was explained in the embodiments. For example, the bulk specific gravity can be varied by adjusting the length of the fiber. Also, other types of fillers may be used in addition to the fiber without affecting the scope of the present invention.

It is also possible to use other microporous insulating material than that used as the core layer 3 in the present embodiment. For example, a type of silica aerogel insulating material compressed in a flexible, heat resistant cloth bag, with the trade name 'Microtherm' (from Micropore International Ltd.), may also be used as the core layer 3. Material having previously undergone hydrophobic treatment can be acquired and so may also be used as the core layer 3.

Furthermore, the core layer 3 is not necessarily microporous insulating material and another material with the same or better level of insulating performance may be used. Should any material better than microporous insulating material be developed, there is no reason why that should not be used.

Microporous insulating material with heat resistance up to 1000–1200° C. are currently available. Its insulating property is 2–3 times better than that of other insulating material which is gained by vacuum forming conventional ceramic fiber. However, this does not mean that heat resistance over 1000° C. and insulating performance 2–3 times better are necessary. To that degree, the material can be found to be effective in practice when used as the core layer 3 in the insulating material 1 of the present invention.

In this way, the use of a material with still better insulating performance is allowed. A higher insulating performance for the core layer 3 necessarily results in a better insulating performance for the insulating material 1 and electrical heating unit 6 of the present invention. It is unnecessary to limit the invention to one core layer 3 and a plurality may be used.

Based on this disclosure, various other modifications, not discussed here, are also possible within the scope of the present invention.

The insulating material of the present invention is of sufficient strength to constitute alone a whole furnace wall insulating layer, easy to handle, and of especially good insulating characteristics. For these reasons, the present invention simplifies furnace construction and can greatly reduce furnace construction costs. Moreover, the present invention can contribute greatly to reducing the load on the global environment due to its superior energy saving effects.

In addition to all the effects of the abovementioned insulating material, the electrical heating unit of the present invention can alone constitute furnace walls with built-in heating elements. For these reasons, the present invention can further simplify furnace construction and reduce furnace construction cost.

With the manufacturing method of the present invention, this high performance insulating material and electrical heating unit can be manufactured easily and at low cost.

What is claimed is:

1. A heat insulating material being a single unit having an outer layer comprising mainly refractory inorganic fiber and a core layer supported within and joined to the outer layer and enclosed inside the outer layer;

wherein the outer layer has a substantial thickness and greater mechanical strength than the core layer; the core layer comprises a composition having a greater insulating performance than the outer layer, and the core layer extends in a plane substantially perpendicular to the thickness of the heat insulating material.

2. The heat insulating material, according to claim 1, wherein the core layer essentially comprises a microporous insulating material.

3. An electrical heating unit comprising a heating element embedded at least partially near one surface of the outer layer of the heat insulating material, according to claim 1 or 2, so that the heating element is supported by and joined with the heat insulating material; and terminals for supplying power to the heating element protruding from a surface opposite said surface of the outer layer.

4. An electrical heating unit having a heat insulating material having an outer layer comprising mainly refractory inorganic fiber;

a core layer supported within and joined to the outer layer; and a groove formed in one surface of the outer layer and at least part of the heating element is embedded in the bottom of the groove, so as to be joined and supported therewith, wherein the outer layer has a substantial thickness and greater mechanical strength than the core layer, the core layer comprises a composition having a greater insulating performance than the outer layer, and the core layer extends in a place substantially perpendicular to the thickness of the heat insulating material.

5. A method for manufacturing a heat insulating material as a single unit comprising the steps of:

building up under compressive force a first heat insulating layer comprising mainly refractory inorganic fiber;

positioning on the first heat insulating layer a core layer comprising a composition with a better insulating performance than said first heat insulating layer and having dimensions smaller than the first heat insulating layer; and building up under compressive force a second heat insulating layer comprising mainly refractory inorganic fiber so that the core layer is completely enclosed and supported therein.

6. The method for manufacturing an insulating material, according to claim 5, wherein the first and second insulating layers are built up by vacuum forming process.

7. The method for manufacturing an insulating material, according to claim 5 or 6, wherein a principal binder component added to the core layer is inorganic colloidal silica.

8. The method for manufacturing an insulating material, according to claim 6, wherein the first and second insulating layers are formed using aqueous slurry wherein refractory inorganic fiber is dispersed.

9. The method for manufacturing an insulating material, according to claim 6, wherein vacuum forming is carried out after the core layer, essentially comprising microporous insulating material, is covered with a waterproof membrane.

10. A method for manufacturing an electrical heating unit as a single unit comprising the steps of:

building up under compressive force a first heat insulating layer comprising mainly refractory inorganic fiber, at least partially embedding a heating element near a surface of the first heat insulating layer positioning on the first heat insulating layer a core layer comprising a composition with a better insulating performance than said first insulating layer and having dimensions smaller than the first heat insulating layer; and building up under compressive force a second heat insulating layer comprising mainly refractory inorganic fiber so the core layer is enclosed.

11. A single unit heat insulating material made by the steps comprising:

building up under compressive force a first heat insulating layer comprising mainly refractory inorganic fiber;

positioning on the first heat insulating layer a core layer comprising a composition with a better insulating performance than said first heat insulating layer and having dimensions smaller than the first heat insulating layer; and building up under compressive force a second heat insulating layer comprising mainly refractory inorganic fiber so that the core layer is completely enclosed and supported therein.

12. An electrical heating unit made by the steps comprising:

building up under compressive force a first heat insulating layer comprising mainly refractory inorganic fiber;

embedding at least part of a heating element in the first heat insulating layer, positioning on the first heat insulating layer a core layer comprising a composition with a better insulating performance than said first heat insulating layer and having dimensions smaller than the first heat insulating layer; and building up under compressive force a second heat insulating layer comprising mainly refractory inorganic fiber so that the core layer is completely enclosed and supported therein.

* * * * *

UNITED STATES PATENT AND TRADEMARK OFFICE

CERTIFICATE OF CORRECTION

PATENT NO. : 6,150,643
DATED : November 21, 2000
INVENTOR(S) : Kitamura et al.

It is certified that error appears in the above-identified patent and that said Letters Patent is hereby corrected as shown below:

Claim 7,
Line 3, change "core" to -- outer --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*